US005810990A

United States Patent [19]

Ikegaya

[11] Patent Number: 5,810,990

[45] Date of Patent: Sep. 22, 1998

[54] METHOD FOR PLATING AND FINISHING A CYLINDER BORE

[75] Inventor: Hirohiko Ikegaya, Iwata, Japan

[73] Assignee: Yamaha Hatsudoki Kabushiki Kaisha, Iwata, Japan

[21] Appl. No.: 579,948

[22] Filed: Dec. 28, 1995

[30] Foreign Application Priority Data

Dec. 28, 1994 [JP] Japan ..... 6-328842

[51] Int. Cl.[6] ..... C25D 5/02; C25D 5/48

[52] U.S. Cl. ..... 205/122; 205/131; 205/220; 205/222; 451/54

[58] Field of Search ..... 205/220, 222, 205/151, 131, 122; 451/54

[56] References Cited

U.S. PATENT DOCUMENTS

| | | | |
|---|---|---|---|
| 3,793,160 | 2/1974 | Homan | 204/39 |
| 4,065,365 | 12/1997 | Ibarguengoitia | 204/25 |
| 4,067,782 | 1/1978 | Bailey et al. | 205/151 |
| 4,978,431 | 12/1990 | Brannan et al. | 205/137 |

OTHER PUBLICATIONS

Frederick A. Lowenheim, *Electroplating*, McGraw–Hill Book Co., New York, 1978, pp. 99–109, 139–140, 230–239.

*Primary Examiner*—Kathryn L. Gorgos
*Assistant Examiner*—William T. Leader
*Attorney, Agent, or Firm*—Knobbe, Martens, Olson & Bear LLP

[57] ABSTRACT

A method for continuously plating and finishing a part wherein a surface of the part is plated by a process that raises its temperature above atmospheric temperature and the part is then immediately force cooled to a temperature at which the plated surface may be properly machined. The part may be a cylinder block having at least one cylinder bore which is plated by flowing plating liquid across the surface of the cylinder bore and applying an electrical potential to cause plating material to be deposited. The cylinder block may be cooled by forced air cooling or liquid cooling to atmospheric temperature and then the plated cylinder bore may be immediately finish honed.

4 Claims, 4 Drawing Sheets

METHOD FOR PLATING AND FINISHING A CYLINDER BORE

BACKGROUND OF THE INVENTION

This invention relates to a plating system and method and more particular to an improved manufacturing process and apparatus.

It has been proposed, with internal combustion engines, to utilize an aluminum cylinder block in which a cylinder liner is formed from a material that will provide good wear properties with the aluminum pistons normally employed in such engines. Frequently, pressed or cast-in liners are employed for this purpose. However, there are a number of disadvantages to the utilization of such separate liners, which involve cost, weight and like matters.

There has been proposed, therefore, an improved process by which the cylinder bore of the aluminum cylinder block is coated or plated with a metallic lining by a plating process that provides rapid plating and the deposition of the desired material to the desired thickness. Such systems are quite advantageous, because they can significantly improve the performance of the engine, as well as reducing the cost of manufacturing it.

With this plating process, there is provided a circulating fluid containing the plating material which is passed across the surface to be plated at a fairly high velocity and with an electrical potential thereacross to cause deposition of the material on the cylinder bore surface. This plating process involves several steps, and at the completion of the plating process, the actual material is at an elevated temperature.

Therefore, it has been previously the practice to process the cylinder blocks and form the plating on them. The blocks are then permitted to stand for some time period to cool and before the bores are finish honed. Obviously, this takes time and adds cost to the process in the final engine.

It is, therefore, a principal object of this invention to provide an improved plating method and method for forming a cylinder block wherein the process can be formed continuously as part of the overall assembly and manufacture of the engine.

It is a further object of this invention to provide an improved and simplified manufacturing process and method whereby a cylinder block can have its liners plated and thereafter honed after a very short time interval.

It is a further object of this invention to provide an improved manufacturing process and method whereby cylinder bores may be plated and honed in a continuous process.

SUMMARY OF THE INVENTION

This invention is adapted to be embodied in a process and apparatus for forming finished cylinder bores from a light alloy material. The light alloy material is processed on a line embodying a number of plating steps with washing steps taking place therebetween. Upon the completion of plating, a cooling process follows so that the cylinder block and plated bore can be immediately honed.

DETAILED DESCRIPTION OF THE PREFERRED EMBODIMENTS OF THE INVENTION

Figure 1:
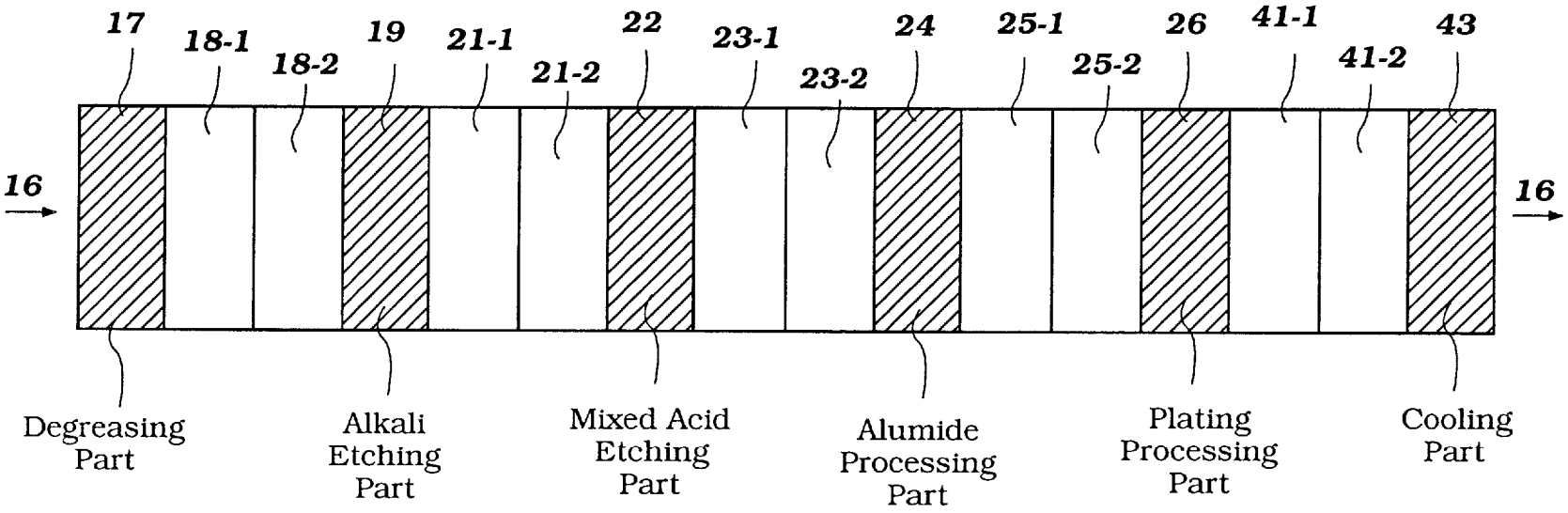
FIG. 1 is a partially schematic view showing a portion of a plating process and manufacturing process in accordance with a first embodiment of the invention.
Figure 2:
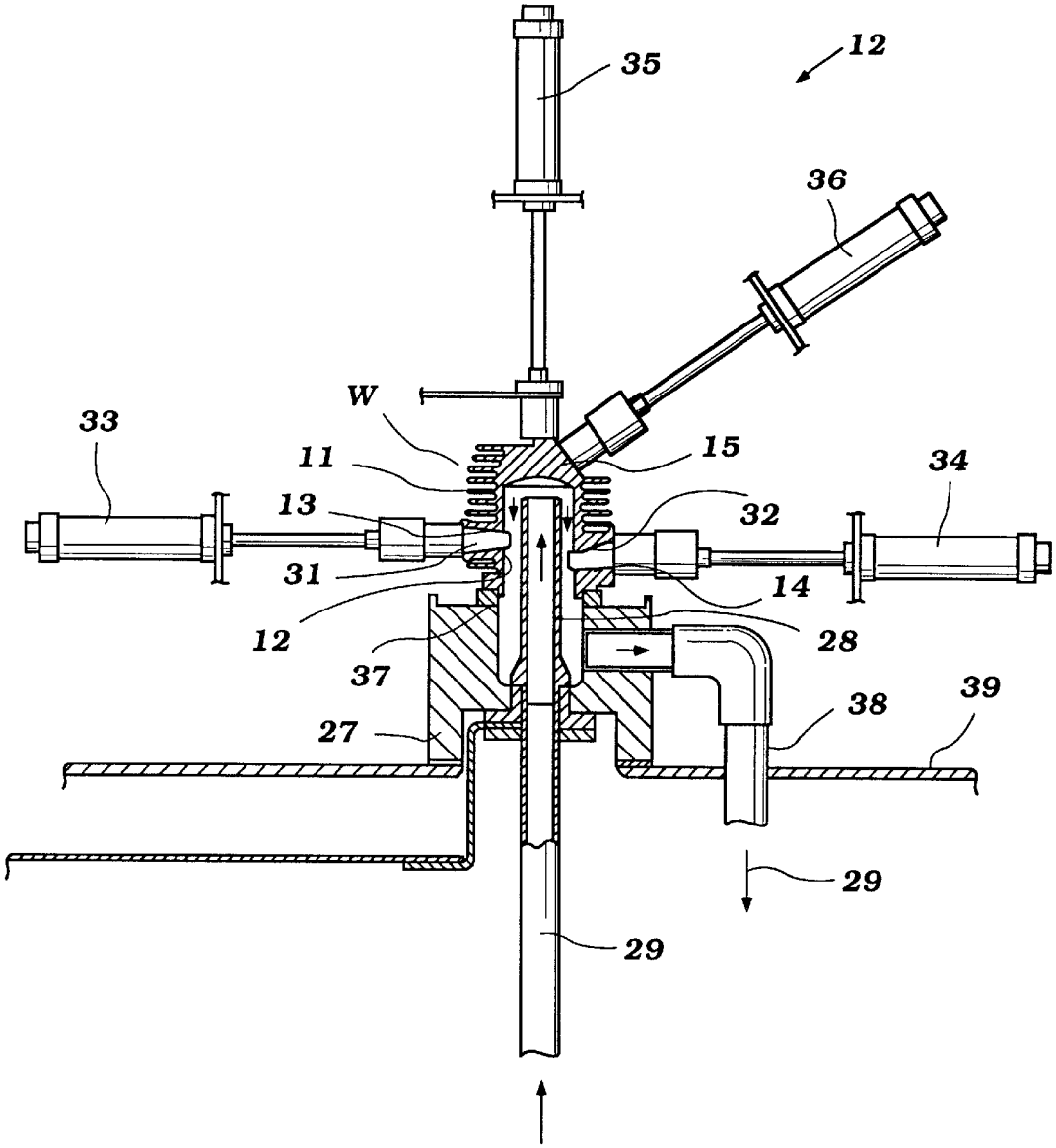
FIG. 2 is an enlarged cross-sectional view showing the apparatus during the actual plating of the workpiece.

Referring now in detail to the drawings, and initially to FIGS. 1 and 2, a portion of a manufacturing process constructed in accordance with an embodiment of the invention is shown schematically in FIG. 1, and the actual plating process performed therein is shown by a cross-sectional view of FIG. 2. In the illustrated embodiment, a workpiece W, which may be comprised of a cylinder head and cylinder block assembly, indicated generally by the reference numeral 11, and which has a cylinder bore 12, a scavenge port 13 and an exhaust port 14, and to which is affixed an integral cylinder head 15, is processed so that the cylinder bore 12 is formed with a thin, wear-resistant plating on the base material of the cylinder block, cylinder head W. This member W may be formed from an aluminum or aluminum alloy casting.

In addition to forming the plating coating on the cylinder bore 13, as a part of the process, the plated workpiece W is cooled to an appropriate temperature so that the cylinder bore 12 or, more specifically, its plated lining, can be finish honed.

Referring now primarily to FIG. 1, the workpieces W are placed on a conveyor, indicated schematically by the arrows and identified generally by the reference numeral 16, so as to flow through a plurality of stations progressing from left to right, as shown schematically in this figure.

The stations which will be described are organized and sized in such a way that the conveyor 16 may operate at fixed constant time intervals, moving the parts W from one station to the next in a fixed time sequence. In this way, parts may be moved continuously. Although this type of operation is preferred, it will be apparent to those skilled in the art that the invention may also be utilized in a method wherein the processing of the parts is done in nonuniform steps.

In the first station, indicated schematically at 17, the workpieces W are degreased by immersing them in a suitable solvent. The part is then transferred to the first of a plurality of washing stations 18-1 and 18-2, which may comprise nothing more than water tanks wherein water is circulated, and in which the workpiece W is immersed for a predetermined time period so as to clean the part of the degreasing fluid.

The part then is moved to the next processing station 19 of the plating process, where the part is alkali etched. From the alkali etching, the part is then moved to further cleaning or washing stations 21-1 and 21-2, wherein the workpiece W is again immersed in a cleaning fluid, such as water. These intermediate washing steps are to ensure that the fluids from the various stations where chemical processes take place do not become mixed with each other through adherence to the workpiece W.

After the second washing in the stations 21-1 and 21-2, the workpiece W is moved to the station 22 where the next portion of the plating process is performed. This constitutes a mixed acid etching of the part utilizing the appropriate acids in accordance with any of the plating methods known in the art. The part is then again washed in washing stations 23-1 and 23-2.

The part then is presented by the conveyor 16 to the next plating processing station 24, wherein the workpiece 24 is treated with an aluminide processing to perform an aluminide surface treatment at least on the cylinder bore 24. The part is then moved to further washing stations 25-1 and 25-2 for washing, for example, with water.

The part then moves to the actual plating processing section 26, which is shown in detail in FIG. 2 and will now be described by reference to that figure.

The conveyor or a robot in the station 26 places the cylinder block cylinder head assembly W on a base fixture 27 through which an upstanding delivery pipe 28 extends. The delivery pipe receives fluid which flows along a path indicated by the line and arrows 29 into the interior of the cylinder bore 12. This plating material is a solution containing the actual alloy which will be deposited on the cylinder bore 12.

The scavenge port 13 and exhaust port 14 are closed by stopper plugs 31 and 32, respectively. The closure plugs 31 and 32 are actuated by pneumatic or hydraulic cylinders 33 and 34. At the same time, the workpiece W is held in place by a pair of holding cylinders 35 and 36 so as to assure a tight seal at the base of the cylinder bore with a seal 37 carried by the fixture 27.

The plating fluid flows across the cylinder bore surface 24 and then is discharged through the fixture 27 through a discharge fitting 38. The plating apparatus comprised of the elements described is all mounted on a base 39 which forms a portion of the section 26 to which the workpieces W are delivered. An electrical potential is established during the high speed liquid flow to effect deposition of the plating material on the cylinder bore 24 to form the thin lining to the desired thickness.

After the plating process, the part W is again washed in washing stations 41-1 and 41-2. The part is then delivered to a cooling station 43 where the temperature of the workpiece W, which will have been elevated by the plating processes, is lowered to an ambient temperature such that finish honing of the part can occur in the next station along the conveyor line 16. The various ways in which the workpiece W may be cooled will be described later, primarily by reference to FIGS. 4 and 5.

Figure 3:
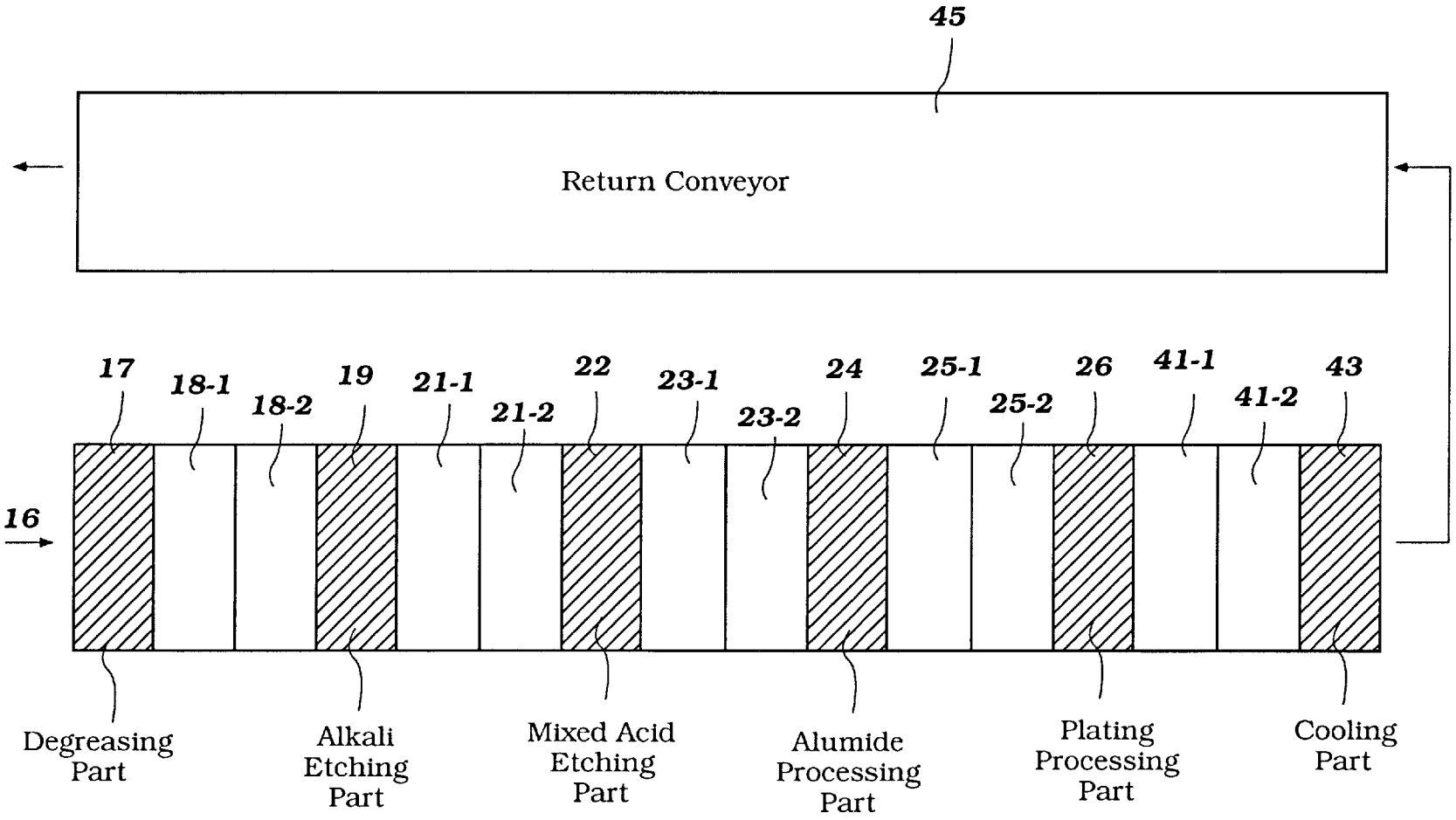
FIG. 3 is a schematic view, in part similar to FIG. 1, and shows another embodiment of the invention.

FIG. 3 shows another processing embodiment, which is basically the same as the embodiment of FIG. 1. However, in this embodiment, the workpieces are transferred from the conveyor 16 to a return conveyor, indicated generally by the reference numeral 45. Along this return conveyor 45, there may be provided further stations wherein various processes, including the honing, assembly, etc., are performed on the workpiece W. That is, with either embodiment of the invention, the general purpose is to have the workpieces moved from basically the base material of the cylinder block through the plating process, a honing process and a final assembly of the total engine.

Alternatively, the plated and honed cylinder blocks may be stored at a desired location and drawn on as required, depending upon the preferred manufacturing process.

Figure 4:
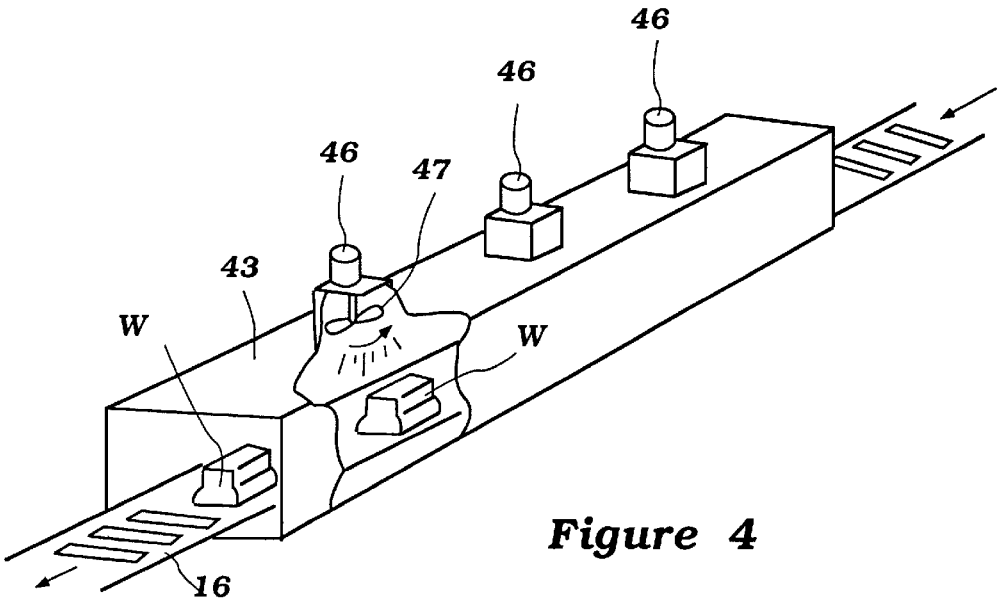
FIG. 4 is an enlarged perspective view, with a portion broken away, showing one of the cooling methods, in accordance with an embodiment of the invention.

FIG. 4 shows an air cooling tunnel, which has been identified by the reference numeral 43, the same as that employed in FIGS. 1 and 3, because this is one of the ways in which the workpieces W can be cooled after their final washing step in the washing step in the washing station 41-2. The cooling tunnel 43 is provided with a plurality of fan motors 46, each of which is coupled to drive a respective fan blades 47 that will circulate air over the workpieces W, and specifically along an a path that will flow into the cylinder bores 12.

For this purpose, the cylinder block cylinder head assemblies W may be inverted when they pass on the conveyor 16 through the cooling tunnel 43. In this way, it is possible to lower the temperature. The air circulated by the fans 47 may be drawn from a cool environment, or may merely comprise atmospheric air, as long as this air is at or close to a temperature which will be adequate to cool the cylinder blocks W to the temperature at which honing can be performed.

Figure 5:
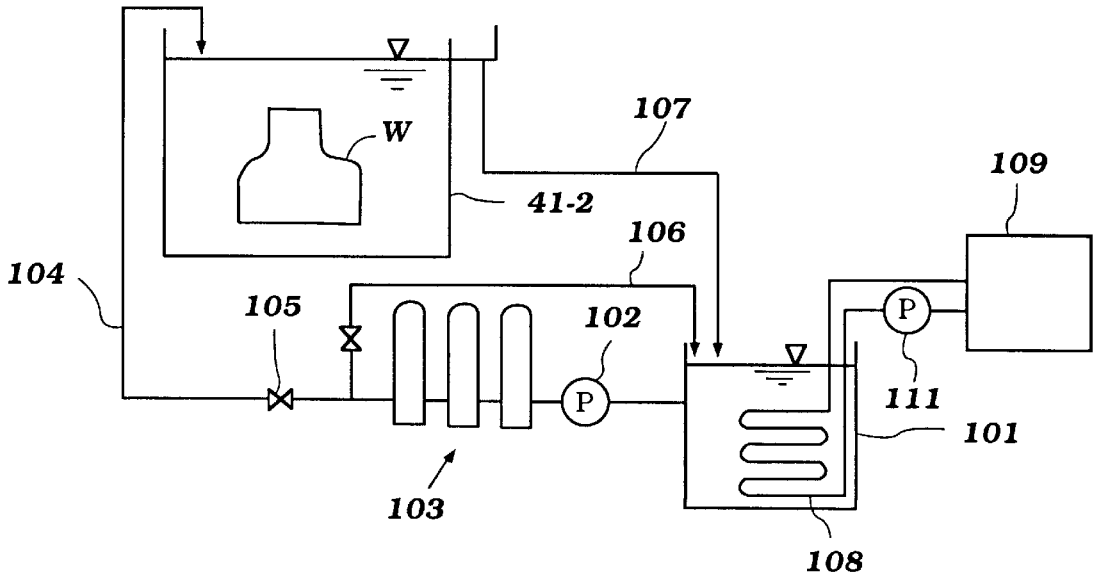
FIG. 5 is a partially schematic view showing another cooling method in accordance with another embodiment of the invention.

In addition to air cooling, it is also possible to liquid cool the part W after the plating process, and FIG. 5 shows such an embodiment. In fact, in this embodiment, the actual cooling process can take place in the second washing tank 41-2 of the final washing process, by way of example.

In order to accomplish this, a supply tank, indicated generally by the reference numeral 101, is provided which supplies water to a circulating pump 102 which, in turn, circulates the water through a plurality of ion exchangers 103. From the ion exchangers 103, water is delivered to the washing tank through a conduit 104. A control valve 105 is provided in the conduit 104 and can bypass a portion of the circulated liquid back to the storage tank 101 through a return line 106.

The washing tank 41-2 is provided with a weir that has a return line 107 that returns the washing fluid back to the storage tank 101.

The temperature of the circulated liquid, which preferably comprises water, is maintained at a low level by circulating a refrigerant through a heat exchanger 108 that is positioned in the storage tank 101 and which is cooled by an cooler 109. A pump 111 circulates the refrigerant through the cooling coil 108 so as to maintain the circulated washing water at the desired temperature.

If desired, the actual liquid cooling may take place in a plurality of washing tanks, such as the tanks 41-1 and 41-2, and/or air and water cooling may be utilized in conjunction with each other.

Thus, from the foregoing description, it should be readily apparent that the described method and apparatus is effective in permitting engine parts to be both plated and finish machined on the same or adjacent assembly lines. Thus, the processing can be speeded up through the incorporation of the cooling cycle at the end of the plating process.

Of course, the foregoing description is that of preferred embodiments of the invention, and various changes and modifications may be made without departing from the spirit and scope of the invention, as defined by the appended claims.

What is claimed is:

1. A continuous method for plating and finishing a cylinder block having at least one cylinder bore, comprising the steps of plating substantially only the cylinder bore of the cylinder block by flowing Plating liquid across the surface of the cylinder bore and applying an electrical potential thereby generating heat in said cylinder block to raise its temperature substantially above atmospheric temperature, force cooling the cylinder block immediately after plating to substantially atmospheric temperatures and finish honing the plated cylinder bore immediately after the plating and cooling steps and in substantially the same area that was plated, said continuous method being carried out on an assembly line.

2. The method for plating and finishing a cylinder block of claim 1, wherein the cooling is accomplished by air cooling.

3. The method for plating and finishing a cylinder block of claim 1, wherein the cooling is accomplished by liquid cooling.

4. The method for plating and finishing a cylinder block of claims 3, wherein the liquid cooling comprises cooling in a washing liquid at the completion of the plating step.

* * * * *